US008253346B2

(12) United States Patent
Budike, Jr.

(10) Patent No.: US 8,253,346 B2
(45) Date of Patent: Aug. 28, 2012

(54) MULTI CONFIGURABLE LIGHTING AND ENERGY CONTROL SYSTEM AND MODULES

(76) Inventor: Lothar E. S. Budike, Jr., Villanova, PA (US)

( * ) Notice: Subject to any disclaimer, the term of this patent is extended or adjusted under 35 U.S.C. 154(b) by 474 days.

(21) Appl. No.: 12/453,069

(22) Filed: Apr. 28, 2009

(65) Prior Publication Data

US 2010/0007289 A1 Jan. 14, 2010

Related U.S. Application Data

(60) Provisional application No. 61/071,423, filed on Apr. 28, 2008.

(51) Int. Cl.
*H05B 41/36* (2006.01)

(52) U.S. Cl. ..... 315/291; 315/307; 315/308

(58) Field of Classification Search ..... 315/291, 315/DIG. 4, 294, 295, 297, 299, 307, 308, 315/312, 361
See application file for complete search history.

(56) References Cited

U.S. PATENT DOCUMENTS 4,289,993 A 9/1981 Harper et al.
5,672,941 A 9/1997 Callahan et al.
5,726,644 A 3/1998 Jednacz et al.
5,838,116 A 11/1998 Katyl et al.
6,340,864 B1 1/2002 Wacyk
6,388,399 B1 5/2002 Eckel et al.
6,707,256 B2 3/2004 Brunker et al.
7,109,668 B2 9/2006 Pogodayev et al.
7,118,235 B2 10/2006 Barton
2002/0175641 A1 11/2002 Andersen
2003/0090889 A1 5/2003 Wacyk et al.
2006/0284728 A1 12/2006 Rubinstein et al.
2008/0111498 A1 5/2008 Budike

*Primary Examiner* — Douglas W Owens
*Assistant Examiner* — Jianzi Chen
(74) *Attorney, Agent, or Firm* — McKenna Long & Aldridge, LLP

(57) ABSTRACT

The present disclosure generally relates to lighting and energy control systems. In some embodiments, a control module is provided that can facilitate installation of lighting systems and control power consumption. Control module may control a ballast coupled to one or more lamps in a light fixture or energy consuming devices on a circuit. The control module can retrofit with various junction boxes or light fixtures and thus enable energy and sensor controls to be deployed in a wide variety of lighting installations which may be inaccessible due to cost or installation constraints. Control device may include a control circuit which provides relaying and one or more interfaces to provide power controls to various devices, such as ballasts, motors, appliances, or other devices.

23 Claims, 10 Drawing Sheets

MULTI CONFIGURABLE LIGHTING AND ENERGY CONTROL SYSTEM AND MODULES

CROSS REFERENCE TO RELATED APPLICATIONS

This application claims priority to U.S. Provisional Application No. 61/071,423, filed on Apr. 28, 2008, and the benefit of U.S. patent application Ser. No. 11/599,621, filed on Nov. 15, 2006, the contents of which are hereby incorporated herein by reference for all purposes in their entirety.

BACKGROUND

1. Field

The present disclosure generally relates to control systems and modules. More specifically, the present disclosure relates to systems and controls for lighting and other devices.

2. Discussion of the Related Technology

A building may include one or more lighting systems; heating, ventilation, air conditioning (HVAC) systems; electrical systems, etc. Typically, these systems are installed when the building is constructed and include circuitry or wiring which may be obstructed by walls, ceilings, and the like. In addition, these systems are often controlled by on or off switches.

SUMMARY

Unfortunately, having more sophisticated power controls for the different systems in a building can be difficult because it may require re-wiring. Accordingly, investment and installation in energy controls for these systems, such as lighting systems, electrical systems, HVAC systems, boiler systems, heating systems, etc., typically does not occur. The use of power controls can result in a tremendous amount of energy savings.

Accordingly, a control module capable of controlling lighting or other energy consuming devices is provided. The control module can include an interface including an input operable to receive an input signal configured to control a level of light emitted by a light source from a receiver and a power output operable to power the receiver. The control module may further include another interface including one or more outputs configured to provide a control signal to adjust light emitted by one or more additional light sources based on the input signal.

The one or more outputs of the interface may include at least one dry contact configured to pass through the input signal. In addition, the input signal can provide on or off control to the light source and additional light sources. Alternatively, the input signal can provide dimming control to the light source and additional light sources. In some embodiments, the above-mentioned interfaces can be provided on different sides of the control module.

In another aspect, a lighting system capable of reducing energy consumption is provided. The lighting system can include a junction box and a control module. The control module can include an interface having a power supply line configured to provide a supply voltage to a power supply and a relay line configured to relay a signal to control light emitted by at least one light fixture using the junction box.

In an embodiment, the relay line can be operably connected to the junction box through a knock out hole. In addition, the power supply line can be operably connected to the junction box to receive the supply voltage. The control module can further include a dimming line configured to provide dimming control to a ballast provided within a housing of the at least one light fixture. The dimming line may run through a hole provided in the housing and connect with the ballast.

In some embodiments, a lighting system which includes an interface cable and a control module is provided. The interface can be operable to receive an input signal configured to control a level of light emitted by a light fixture from a receiver and a power output operable to power the receiver when connected by the interface cable to the receiver. In an embodiment, the control module can be positioned inside a housing of the light fixture.

The housing can be configured to provide a hole when a knock out piece of the housing is removed. In addition, the interface may be operable to be connected to the receiver through a first hole provided in the housing. The control module may include one or more power supply lines which exit the housing through a first hole and the interface cable may exit the housing through a second hole. Additionally, the control module can further include one or more relay lines which exit the housing through a first hole and the interface cable may exit the housing through a second hole.

Advantages and features of the disclosure in part may become apparent in the description that follows and in part may become apparent to those having ordinary skill in the art upon examination of the following or may be learned from practice of the disclosure. The advantages and features of embodiments of the present disclosure may be realized and attained by the structures and processes described in the written description, the claims, and in the appended drawings.

It is to be understood that both the foregoing general description and the following detailed description are exemplary and explanatory and should not be construed as limiting the scope of the claims.

BRIEF DESCRIPTION OF THE DRAWINGS

The accompanying drawings are included to provide a further understanding of the disclosure, and are incorporated herein and constitute a part of this application. The drawings together with the description serve to explain exemplary embodiments of the present disclosure. Wherever possible, the same reference numbers will be used throughout the drawings to refer to the same or like parts. In the drawings.

DESCRIPTION OF THE EMBODIMENTS

The present disclosure generally relates to lighting and energy control systems. In some embodiments, a control module is provided that can facilitate installation of new light fixtures, light sources, or other energy consuming devices. The control module can retrofit with various junction boxes or light fixtures and thus enable energy and sensor controls to be deployed in a wide variety of lighting installations that are inaccessible due to cost or installation constraints.

Figure 1A:
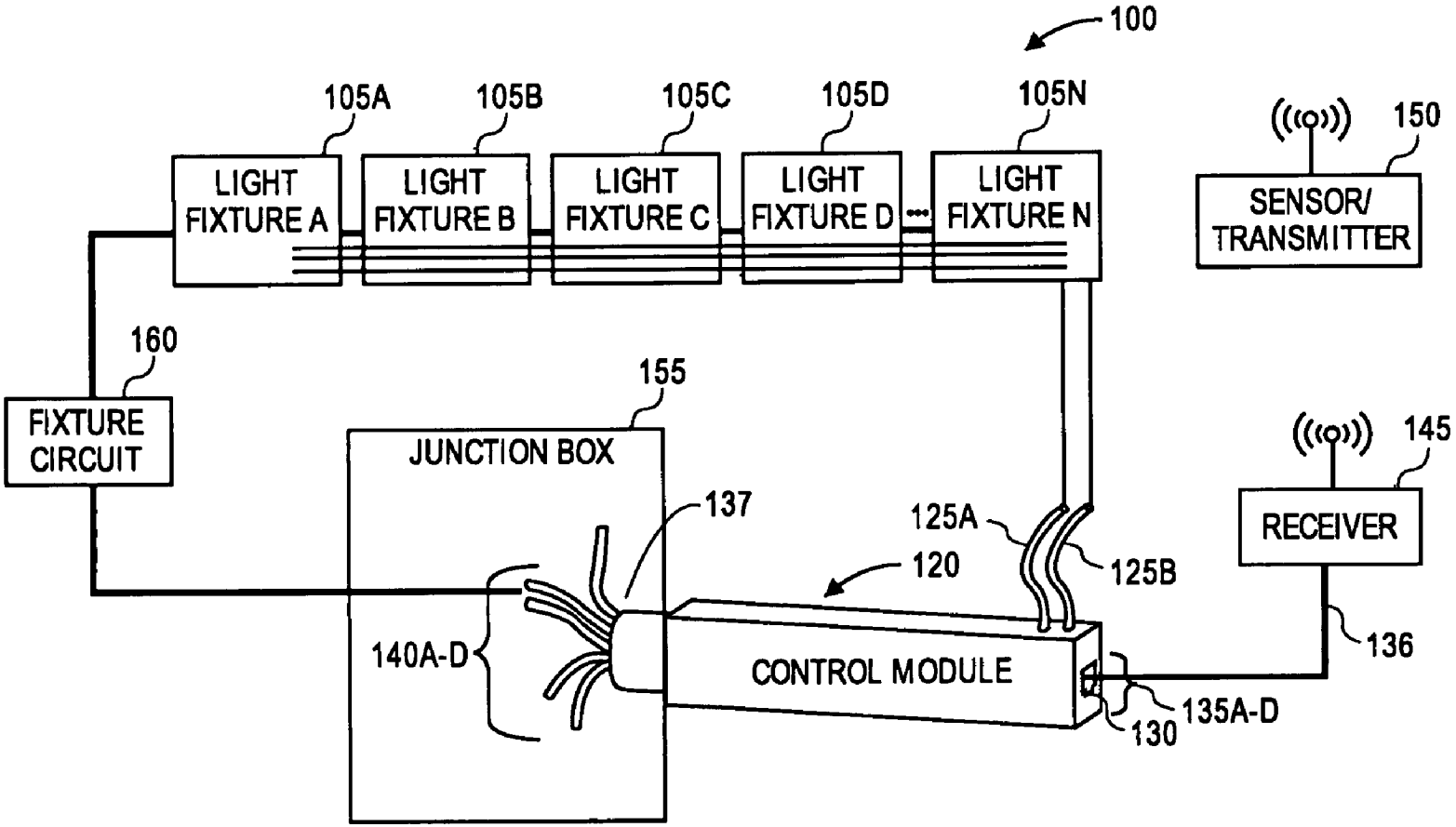
FIG. 1A illustrates an exemplary block diagram of a lighting system capable of controlling and powering one or more light fixtures, according to an embodiment of the disclosure.

FIG. 1A illustrates an exemplary block diagram of a lighting system 100 capable of controlling and powering one or more light fixtures. As shown, a control module or device 120 communicates with a receiver 145, sensor 150, junction box 155, fixture circuit 160, and/or light fixtures 105A, 105B, 105C, 105D, and 105N (representative of any number of light fixtures) through a variety of connections. The junction box 155 can be any standard junction box existing along the power-supply "feeder" to the light fixtures 105A-N or added box by an electrician. The control module 120 draws power from the supply lines and can be wired to interrupt the flow of power to the light fixtures 105A-N—thus offering on-off control of the fixture. For certain fixtures full dimming is offered by 125A-B (as will be explained later). Light fixtures 105A-N could actually represent nearly any type of controllable load including but not limited to one or more ballasts (not shown) and one or more lamps, light bulbs, LEDs, motor, or light sources (not shown). Light fixtures 105A-N can include one or more ballasts (not shown) and one or more lamps, light bulbs, LEDs, or light sources (not shown). Communication within the system 100 may take place over one or more wires, wireless technologies, cables, or other digital or analog techniques, devices to perform these techniques, radio, a local area network (LAN), a wide area network (WAN), or the internet, for example. Of note, control module 120, receiver 145, or sensor 150 may reside on physically separate devices or be combined into the same device.

The junction box 155 may exist as part of a feeder circuit that feeds a string of light fixtures 105A-N or may be added along the conduit. For example, when a building is constructed an electrician may run the supply lines through the conduit and along that conduit may be one or more junction boxes. Into any one of these the electrician may wire up the control module 120 by powering the control module from the power that normally runs to a light fixture and then interrupting the flow downstream to light fixtures through the control module 120 so that the light fixtures can be controlled on and off via the control module 120. For example, an electrician may cut the black hot lead inside the junction box 155, and wire it up along with the white neutral to the control module 120.

Of note, although system 100 shows one receiver 145 and one sensor 150, the system 100 may include one or more receivers 145, one or more sensors 150, and one or more control modules 120. In an embodiment another interface can be added to device 120 essentially "paralleling" the wires to the second 130 interface. This could exist external to the 120 device as a "Y-cable-adaptor" or simply as another interface on the control module 120 itself. For the second interface 130, lines 135A-D can run to a second "daisy-chained" control module in another fixture. Thus one receiver 145 can control multiple control modules. In another embodiment, one or more sensors 150 may transmit control or measurement signals to one or more receivers 145 associated with different lighting zones or areas in a room, building, or hallway, for example. The control or measurement signals transmitted by sensor 150 to receiver 145 can then be sent to control modules 120 which control light fixtures 105A-N associated with the different lighting zones using addressing via dip switches, for example. Based on the transmitted control or measurement signals, light fixtures 105A-N connected or controlled by a particular control module 120 can be individually controlled. In an exemplary embodiment, a series of motion sensor, receiver 145, and control module 120 triples may be used throughout a hallway to turn lighting fixtures 105A-N on and off as an individual progressively walks down the hallway. It should be noted that other configurations of sensors 150, receivers 145, and control modules 120 may also be used.

The receiver 145 can include a wireless interface to wirelessly communicate with one or more sensors 150 or nearly any compatible wireless device, such as a computer with compatible wireless interface, wireless remote control, wireless wall switch, compatible wireless network, etc. Receiver 145 may be remotely mounted or positioned away from sensor 150 and may include a microcontroller. For example, receiver 145 can receive measurements and/or signals from the sensor 150 or a computer which can be used to operate or control light fixtures 105A-N. Based on the received signals or measurements, receiver 145 can provide control signals for light fixtures 105A-N to control module 120. In an embodiment, receiver 145 and control module 120 may advantageously reside separately to reduce electromagnetic interference (EMI) generated by ballasts of light fixtures 105A-N. For example, in some configurations of system 100, receiver 145 may be positioned outside light fixtures 105A-N and control module 120 may reside near or be entirely or partially housed within light fixtures 105A-N.

Sensor 150 can provide on/off and/or dimming controls signals for light fixtures 105A-N. The sensor 150 includes a wireless interface to wirelessly communicate with receiver 145. Various types of sensors 150 can be used in system 100, including motion, light harvest, timer, real-time-clock, remote-control, and the like. In some embodiments, sensor 150 may be positioned separately from receiver 145 because the measurements taken by sensor 150 can be improved by placing sensor away from light fixtures 105A-N and receiver 145. For example, in some embodiments when sensor 150 comprises a light harvesting sensor, light fixtures 105A-N can interfere with ambient light being measured by sensor 150. Thus, separating sensor 150 from receiver 145 can improve operation of system 100. In addition, splitting the functionality of system 100 across the control module 120, receiver 145, and sensor 150 can improve performance of system 100, allow for ease of installation, and reduce installation costs by minimizing wires, for example.

Control module 120 can be installed in a variety of configurations to provide power and controls to light fixtures 105A-N. For example, control module 120 may control one or more ballast(s) which may be coupled to one or more light sources, light bulbs, lamps, LEDs, and the like. In addition, control module 120 may control other energy consuming devices (not shown), such as a motors, heaters, appliances, or other devices having on/off switches. Control module 120 may also be connected to junction box 155, which can advantageously allow fixture circuit 160 to control light fixtures 105A-N when they are strung together. In some embodiments, control module 120 may be connected or wired to junction box 155 directly or through other intermediaries, conduits, or circuits. Control module 120 may include one or more interfaces, such as such as primary interface 137, secondary interface 130, and dimming lines 125A-125B which provide various outputs and inputs as will be further described herein. These interfaces can be combined into the same interface or further divided into separate interfaces. Control module 120 may also include a power supply (not shown) to supply voltage to secondary interface 137, receiver 145, or other components of system 100.

Figure 1B:
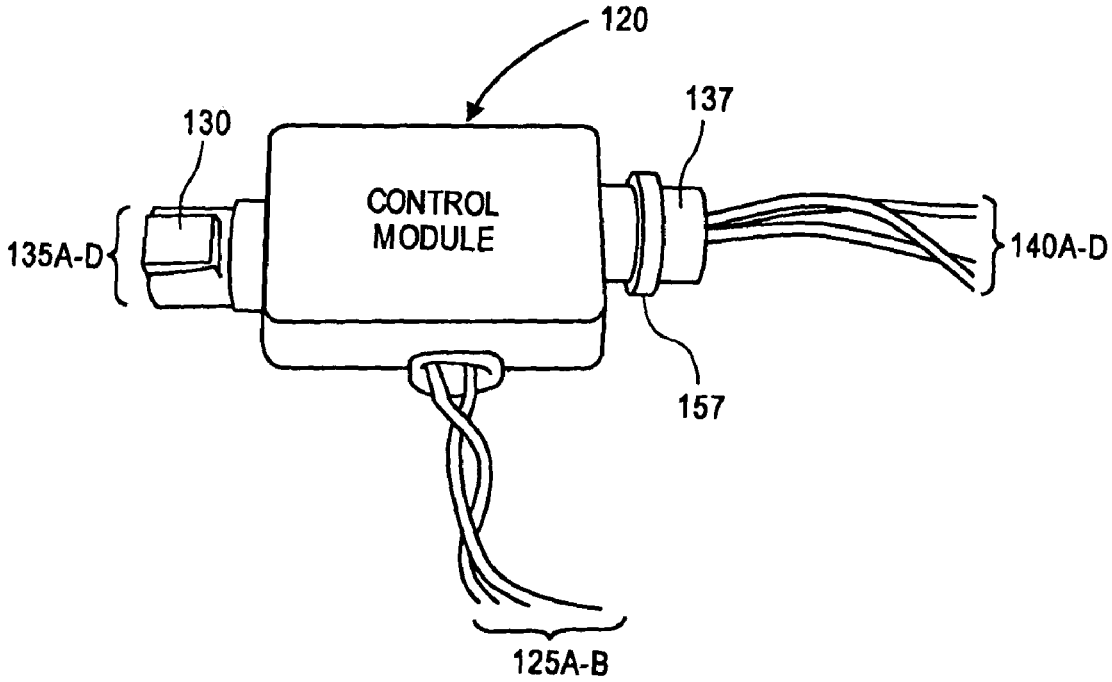
FIG. 1B illustrates an exemplary top elevation view of the control device that may be employed in the system of FIG. 1A.

FIG. 1B illustrates an exemplary top elevation view of the control module 120 that may be employed in the system of FIG. 1A. In the illustrated embodiments, control module 120 may include dimming lines 125A-B for providing a dimming signal to control a dimming ballast (not shown) of light fixtures 105A-N. In exemplary embodiments, dimming lines 125A-B can be purple (or violet) and gray dimming lines and may be made from 18 American wire gauge (AWG) stranded wires. For example, purple dimming line 125A may provide a 0-10 Volt (V) dimming signal and gray dimming line 125B may provide a reference to ground. In addition, control module 120 can include a primary interface 137 which provides controls to light fixtures 105A-N, for example. Primary interface 137 may provide physical/electrical isolation and control of the primary power of light fixtures 105A-N or another load device, such as a motor, heater, or other energy consuming device. For example, primary interface 137 may be coupled to one or more ballasts, such as dimming or non-dimming ballasts, to control power to light fixtures 105A-N.

Primary interface 137 can include one or more primary high-voltage input or outputs, such as a relay wires 140A-B and primary power supply lines 140C-D, for example. Relay wires 140A-B may include two red-color 6 inch leads of 14 American wire gauge (AWG) stranded wires, rated to 105 degrees Celsius (C) and/or 600 Volts (V), for example. Relay wires 140A-B may be connected to relay contacts on the relay device to provide pass through or dimming signals to control light fixtures 105A-N from receiver 145, for example. Of note, dimming lines 125A-B (as described above) and relay wires 140A-B may also be configured to control other ballast types including standard on/off ballasts, step ballasts, or hi/low ballasts. The primary power lines 140C-D may be black and white wires of 18 American wire gauge (AWG) and have substantially similar characteristics as relay wires 140A-B. Primary power lines 140C-D may provide power or to a power supply (not shown) of control module 120.

Control module 120 may further include a secondary interface 130 which can provide low voltage output features to receiver 145, for example. As shown, secondary interface 130 may include a plurality of pins, outputs, or inputs 135A-D. Secondary interface 130 can be a low-cost jack of reliable construction, such as a small class 1 or 2 telephone plug, RJ11, RJ14, or RJ45 plug. In exemplary embodiments, when secondary interface 130 comprises a jack it may have the following pin assignments: pin 135A may provide an input for on/off control of lighting fixtures 105A-N, pin 135B can be a ground reference for other voltages provided, pin 135C may provide an input for controlling a dimming ballast, such as 0 to 10 Volts (V), and pin 135D may provide a power output, such as 12 Volts (V). Pin 135D may be used to provide power to receiver 145, for example. Another RJ-11 jack can be added to the first whereby the lines from the first are paralleled to the second. This then can permit "daisy-chaining" of additional control modules from one receiver offering common control and economic advantage.

In exemplary embodiments, control module 120 may be operatively coupled to receiver 145 through secondary interface 130 via a secondary interface cable 136 (see FIG. 1). Control module 120 can then receive control signals from receiver 145 via input pins 135A and 135C. Control module 120 may implement a relay and provide dimming or pass through signals, which may be based on a signal received from input pins 135A and 135C, to fixture circuit 160. The output signals from the relay and pass through signals, such as primary interface 137 and dimming lines 125A-B, can then be coupled to one or more ballasts of light fixtures 105A-N to control the quantity or amount of light emitted.

Secondary interface 130 can facilitate installation of control module 120 by reducing the amount of wires or cable used to connect receiver 145 or another device. For example, a single cable, such as secondary interface cable 136, can be used to connect secondary interface 130 to receiver 145. In addition, secondary interface 130 can reduce the amount of wire needed to control ballast(s) of light fixtures 105A-N because of the closer proximity of control module 120 to ballast(s) in some installations. For example, an electrician or installer of system 100 may need to run dimming lines 125A-B a short distance inside light fixtures 105A-N to a ballast.

Of note, the control module 120 can be configured for integration into any existing lighting fixture or lighting system and eliminate the need for any customized controllers for a particular ballast design. In addition, the control module 120 may operate one or more lighting fixtures or can be connected to a standard electrical junction box to provide control to an entire circuit. In some embodiments, the control module 120 may receive one or more input signals from a receiver 145. The receiver 145 may receive power controls or measurements for operating light fixtures which may be transmitted wirelessly, for example, from a variety of sensors, such as light harvesting or motion control, or computing devices.

Figure 2A:
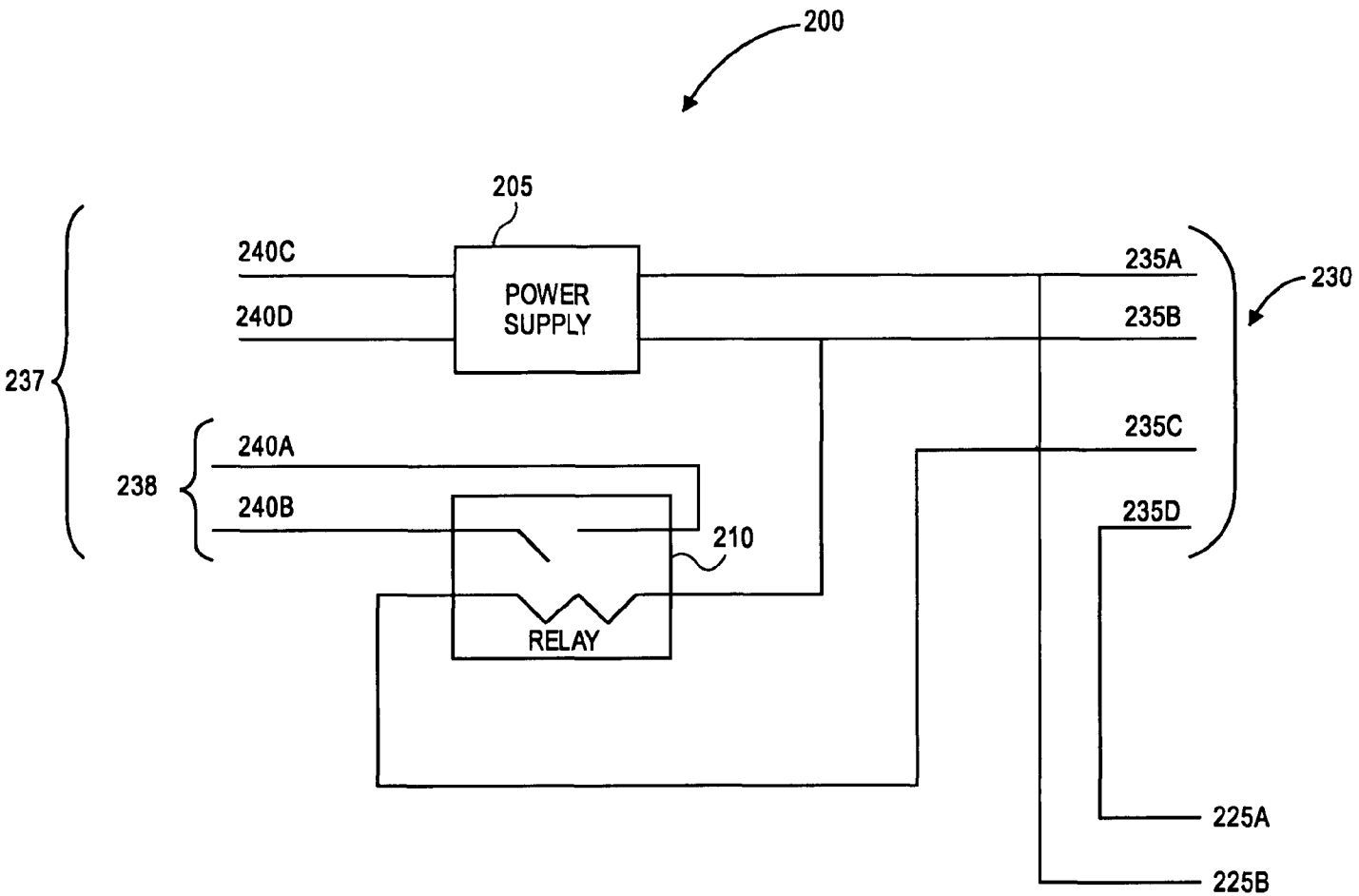
FIG. 2A illustrates exemplary components which may comprise a control device, according to an embodiment of the disclosure.

FIG. 2A illustrates exemplary components which may comprise a control device 200. As shown control device 200 can include a power supply 205, relay 210, dimming lines 225A-B, secondary interface 230, and primary interface 237. Generally, power supply 205 can be a switching or linear supply and may be isolated to allow primary high-voltage lines, such as primary power lines 240C-D which carry approximately about 120 VAC to approximately about 277 VAC, to be separated from lower-voltage lines and other circuitry. While one relay is shown connected to secondary interface 230 for control, it may be extended to more than one relay 210 in the control device 200 via a higher pin-count connector at secondary interface 230. This can allows for control of step and high/lo ballasts or simply multiple ballasts in the same fixture.

Power supply 205 can be capable of producing approximately about 12 volts of direct current (VDC) at approximately about 150 milliamperes (mA). The selection of approximately 12 volts is exemplary, and other output voltages may be accommodated with a different power supply design to handle other voltages and sensors such as 24 volts infrared, ultrasonic, and light-sensitive sensors. As shown, power supply 205 may be connected to primary power lines 240C-D to receive power. Relay 210 may consume approximately about 70 mA of this power when on. The remaining amount of power produced by power supply 205 (approximately about 80 mA) can be sent to pin output 235B of secondary interface 230 for use by energy consuming devices, such as receiver 145. Power supply 205 can use a tapped transformer to accommodate differing supply voltages or may be a "universal input" power supply. In exemplary embodiments, when power supply 205 comprises a universal-input switching power supply it may generate power-line supply voltages from as low as approximately about 85 VAC to over approximately about 377 VAC.

Relay 210 can be a 5 amp, 277 VAC or 20 amp, 277 VAC compatible relay or a semiconductor device-switch. For example, relay 210 can be a power relay, such as manufacturer part number FTR-K3JB012W made by Fujitsu Limited® of Tokyo, Japan or a semiconductor switch, such as a triac or another alternative. In addition, relay 210 may be controlled via a semiconductor device such as a properly biased transistor, MOSFET or opto-isolator. This addition may allow for lower return currents over secondary interface 230 than what a relay 210 may permit. It may also allow relay 210 to remain on when secondary interface cable 136 is not plugged into secondary interface 230 of control module 200.

In the illustrated embodiments, relay 210 may include a dry contact output 238 and primary power lines 240C-D. For example, dry contact output 238 can include two relay wires 240A-B to control additional energy devices. Dry contact output 238 can advantageously allow control module 200 to control a wide variety of additional devices. Most notably, these devices are of the form which may require independent and different—in terms of isolation need—supply and/or loads. For example, as light fixtures 105A-N, without having to inventory the supply voltage of additional devices and/or adjust power supply 205 to create additional supply voltage for the additional devices.

Secondary interface 230 may include pin 235A to provide a ground reference for other voltages provided, pin 235B to provide a power output, such as 12 Volts (V), pin 235C to provide an input for on/off control of lighting fixtures 105A-N, and pin 235D to provide an input for controlling a dimming ballast, such as 0 to 10 Volts (V). Secondary interface 230 may be coupled to receiver 145 via a secondary interface cable 136 (see FIG. 1) to provide power to receiver 145 and receive control signals for light fixtures 105A-N. As shown, dimming lines 225A-B can be connected directly to secondary interface pin 235D and pin 235A of power supply 205 respectively, to provide dimming signals to a ballast from receiver 145. In addition, secondary interface pin 235B can be connected to relay 210 to relay on/off control signals from receiver 145 using dry relay contacts 240A-B.

Figure 2B:
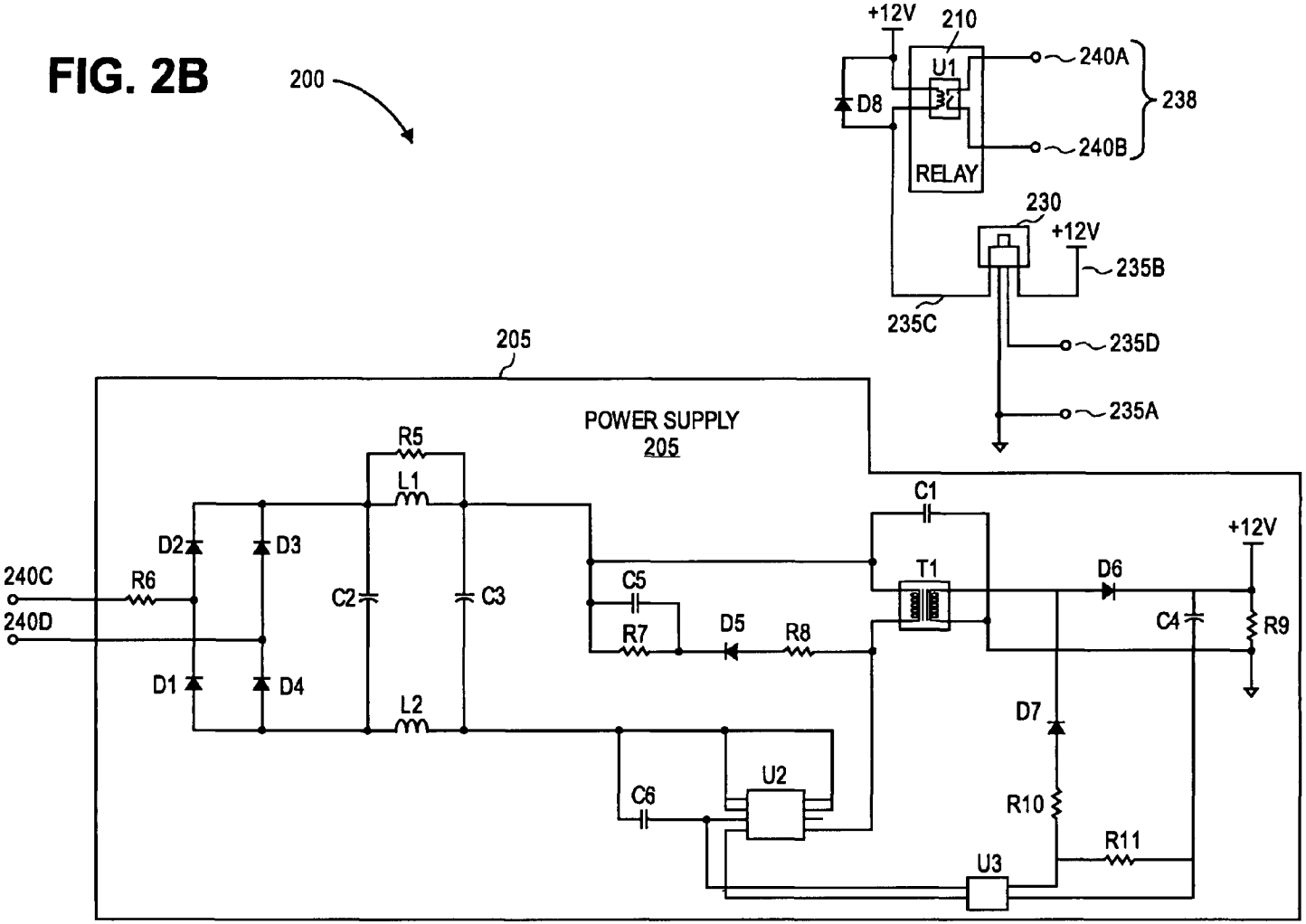
FIG. 2B illustrates an exemplary circuit which may comprise the control device of FIG. 2A, according to an embodiment of the disclosure.

FIG. 2B illustrates an exemplary circuit which may comprise the control module 200 of FIG. 2A. Control module 200 can include an isolated universal-input switching power supply 205, relay 210, secondary interface 230, and primary power lines 240C-D. As shown, secondary interface 230 and its input and output pins 235A-D may be provided as a RJ-11 jack. As further shown, relay 210 can include dry contact output 238, such as dry relay wires 240A-B. Although control module 200 as illustrated may include certain isolators or passive elements, a variety of different elements can be used interchangeably depending on the embodiment. Additionally, control module 200 can be implemented as a digital circuit.

Control module 200 can be configured to provide one or more output signals based on the input signals from receiver to control one or more ballasts of light fixtures, for example. In an embodiment, control module 200 may include a controller to provide output signals to control the light fixtures. Alternatively, a controller may be provided externally, such as on receiver, and control module 200 may relay the control signals provided by the receiver.

The control module may provide relaying and have outputs coupled to one or more interfaces to provide control and power to various devices, such as ballasts, motors, appliances, or other devices having on/off switches. For example, the one or more output signals can be used to provide dimming or on/off control to lamps or light sources coupled to the one or more ballasts. In addition, the outputs can be coupled to a junction box to control a plurality of light fixtures or lighting areas which may be operatively coupled to the junction box through a circuit or wiring, for example.

Figure 3A:
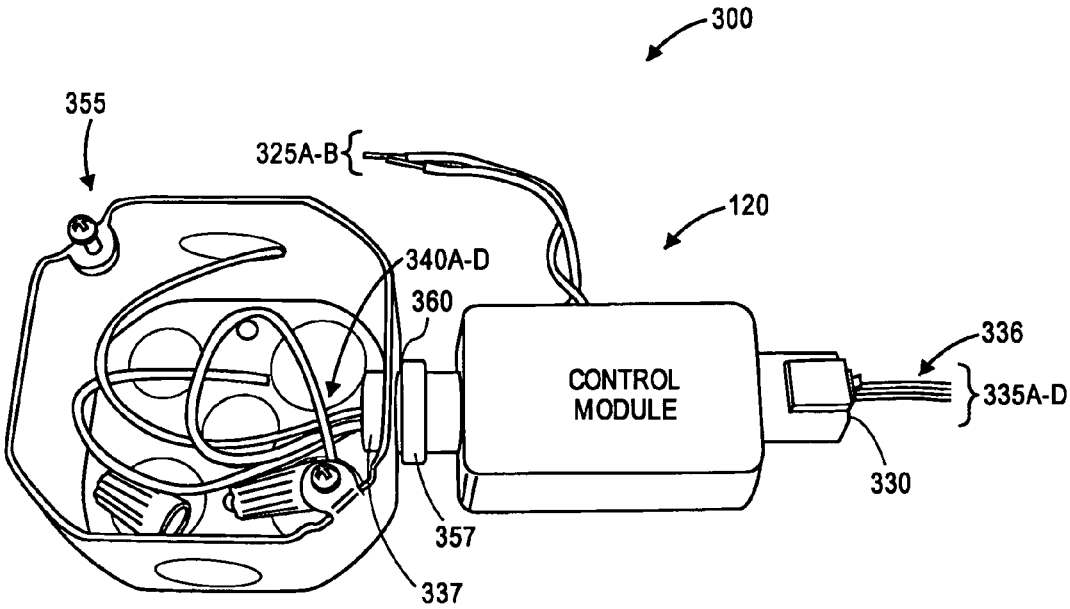
FIG. 3A illustrates an exemplary installation of the control device of FIG. 1A and a junction box, according to an embodiment of the disclosure.

FIG. 3A illustrates an exemplary installation 300 of the control device 120 of FIG. 1A and a junction box 355. As shown, control device 120 may be coupled to junction box 355 by knocking out a standard piece of junction box 355 and inserting primary interface 337 through a knock out hole 360. Additionally, junction box 355 may include other cables or wires which may exit through other knock out holes (not shown) to connect to fixture circuit 160, for example. In this through the knock-out installation, junction box 355 can include lines from a supply voltage to supply power to primary power lines 340C-D of control module 120. In addition, junction box 355 can also include feeder lines that run to lighting fixtures 105A-N and/or a string of lighting fixtures.

In the illustrated embodiment, primary interface 337, relay wires 340A-B and primary power lines 340C-D may be inserted into knock out hole 360. A stop band 357 can be used to snap or lock primary interface in knock out hole 360. Relay wires 340A-B and primary power lines 340C-D may be then be connected to the supply voltage through wires (not shown) or feeder lines (not shown).

Of note, primary supply lines 340C-D can be positioned inside the junction box 355, while low voltage dimming lines 325A-B and/or secondary interface 330 can positioned outside the junction box 355. This can advantageously maintain physical separation and electrical isolation for safety and to meet building code requirements. In addition ballasts or alternate load devices, such as dimmable ballasts in a light fixture or string of light fixtures, can be hooked up to dimming lines 325A-B. For example, depending on code requirements, this connection can be via a regular class II wire, plenum rated wires, or by running a separate conduit for these lines. In addition, if there are no dimmable ballasts or alternate load devices, dimming lines 325A-B can simply be terminated or capped off.

In some embodiments, where light fixtures may be mated in a string like manner, such as side by side, or so called "stringer" applications, primary interface 337 can inserted into a knock-out hole (not shown) of junction box 355. This can allow primary circuits, such as fixture circuit 160, to be operatively coupled to control module 120. Wiring from fixture circuit 160 or other circuits can then be wired within the junction box 355 or primary outlet box to receive control signals from control module 120. In addition, this configuration advantageously allows low-voltage lines, such as secondary interface cable 336 to be kept outside junction box 355 at a safe distance from primary circuit lines.

Figure 3B:
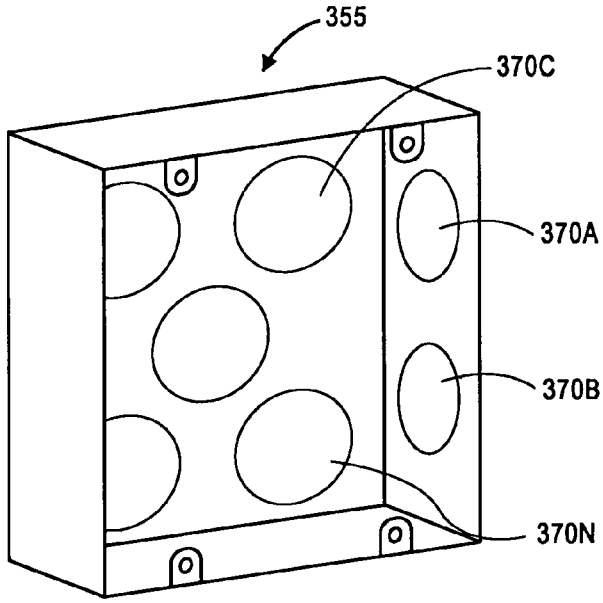
FIG. 3B illustrates an exemplary junction box that may be employed in the installation of FIG. 3A, according to an embodiment of the disclosure.

FIG. 3B illustrates an exemplary junction box 355 that may be employed in the installation 300 of FIG. 3A. Junction box 355 can be used to control a string of light fixtures 105A-N, for example. Advantageously, junction box 355 can allow lighting system 300 to be installed quickly and safely. Junction box 355 may include one or more pre fabricated knock-out or punch out pieces 370A-N on the sides to allow wires and cables, such as power wires, and the like to be run into and out of light fixtures 105A-N. Punch out pieces 370A-N can be approximately about 0.885 inches in diameter and when removed can create holes in light fixtures 105A-N.

For example, a string of light fixtures 105A-N can include a feeder-path along one or more junction boxes 355. When the punch out hole 370A-N is knocked out of a junction box 355, the primary interface 337 of control device 120 can be connected. Additionally, if no junction boxes 355 are present along the feeder-path, junction boxes 355 can easily be installed to interface with the primary interface 337 of control module 120. For example, junction boxes 355 can be installed in the ceiling or mounted to a wall within a residential or commercial facility. Notably, a device load can be controlled by relay lines 340A-B of control module 120 when junction boxes 355 are used, for example.

When knock out pieces 370A-N are removed, knock out holes can be created which allow for physical separation of incoming primary power supply lines, such as approximately about 120-277 VAC, and the 12 V low voltage control lines. This physical separation can greatly improve the safety of a system installation 300. In addition junction box 355 can be placed anywhere in a building or appear anywhere in a building.

Figure 4A:
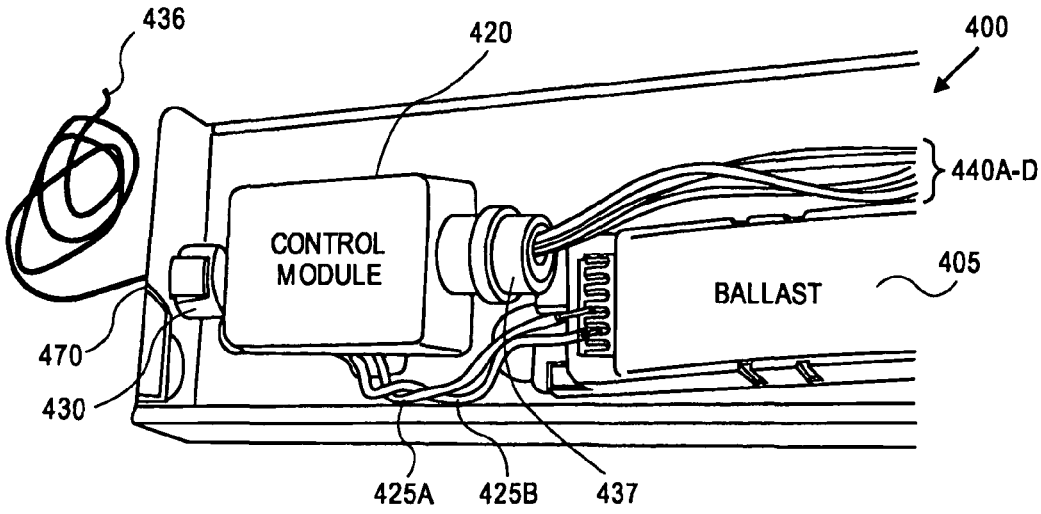
FIGS. 4A-4B illustrate an exemplary installation of a control device of FIG. 1A and a light fixture, according to embodiments of the disclosure.
Figure 4B:
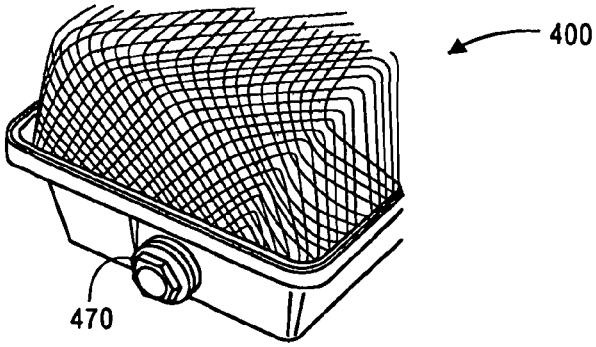

FIGS. 4A-4B illustrate an exemplary installation of the control module 420 of FIG. 1A and a light fixture 400. In FIG. 4A, control module 420 can be housed or positioned within light fixture 400 completely. Alternatively, a portion of control module 420 can be positioned within light fixture 400, such that control module 420 is positioned partially inside light fixture 400. As best shown in FIG. 4B, light fixture 400 can include a punch or knock out piece (on one or more sides of light fixture 400. Knock out pieces 470 may be approximately about 0.885 inches in diameter. When knock out piece 470 is removed, power lines can be run into fixture to control module 420, and in particular, to primary power lines 440C-D of primary interface 437.

With continued reference to FIG. 4A, control module 420 can be inserted completely inside light fixture 400. Control module 420 can be mounted or positioned inside light fixture 400 using double-sticky foam tape or attached via one or more screw holes (not shown). As shown, dimming lines 425A-B can be wired to ballast 405. Primary power lines 440C-D can be coupled to power supply lines provided outside of light fixture 400 by running them through a primary knock out hole (not shown) provided on a primary side of light fixture 400. In addition, relay lines 440A-B may be run outside the primary side of light fixture 400 using the primary knock out hole and run to other light fixtures or a junction box (not shown). Secondary interface 430 may be positioned inside a secondary knock out hole 430 and/or secondary interface cable 436 may run outside secondary knock-out hole 430 and connected to receiver 145, for example. This can advantageously allow low voltage lines, such as dimming lines 425A-B and high voltage lines, such as primary supply lines 440C-D to remain inside the fixture and/or separate from secondary interface cable 436, which can be of a substantially low voltage.

In addition, control module 420 may be wired to light fixture 400 in a junction box like methodology (not shown). For example, control module 420 can be positioned outside of light fixture 400, and primary power lines 440C-D and relay lines 440A-B can be run through a knock-out hole in light fixture 400 from the outside. Dimming lines 425A-B may then optionally be run through another knock out hole to a dimming ballast.

Notably, when control module 420 may be installed inside light fixture 400, primary power lines 440A-D of primary interface 437 may exit by virtue of a standard "knock-out" hole mating piece (not shown) located in light fixture 400. In these so called "in fixture" applications, control module 420 may be partially or fully inserted or housed in light fixture 400. The knock-out piece can be sized and/or configured to accommodate primary interface 437 or other interfaces described herein, such as secondary interface 430, to be inserted and fed through the knock out hole.

Of note, relay lines 440A-B and primary power lines 440C-D exiting through the knock out hole can allow lighting controls to be relayed across a plurality of light fixture 400. This can advantageously additional light fixtures which make up a lighting area to be operated or controlled in similar manner, such as based on sensor 150, for example. In addition, if additional light fixtures include a dimming or other ballast (not shown), the primary power lines 440C-D and/or dimming lines 425A-B can also be connected to the ballast. Secondary interface cable 436 can be fed through the knock out hole and/or placed over primary interface 437 to carry input and output signals 435A-D to receiver 145 which may reside outside light fixture 400. Because the design of light fixture 400 can vary, in some installations it may be beneficial keep secondary interface cable 436 physically separate from primary circuit lines, such as fixture circuit, to avoid malfunction of light fixtures. A second knock out hole may be used to maintain separation between secondary interface cable 436 and primary circuit lines.

Figure 5A:
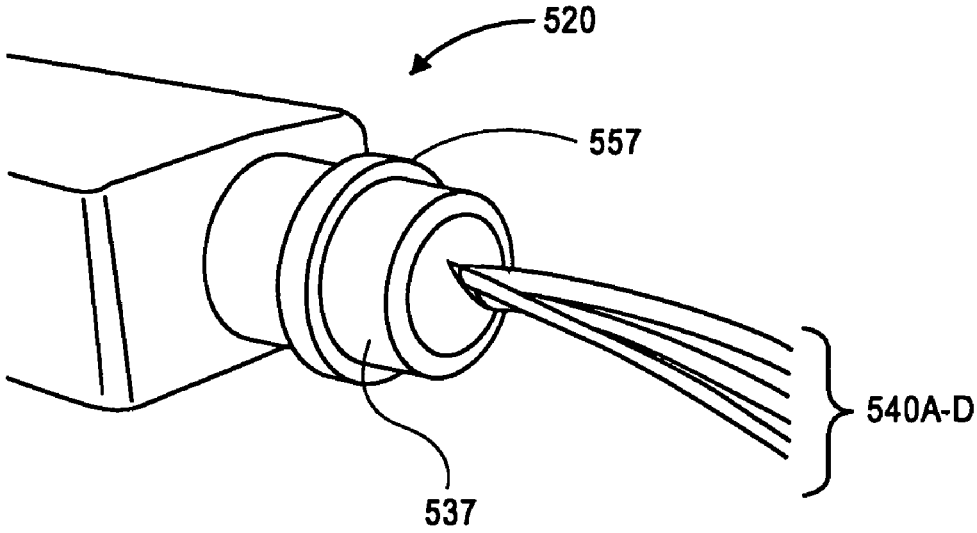
FIGS. 5A-5C illustrate exemplary side views of a control device that may be employed, according to embodiments of the disclosure.
Figure 5B:
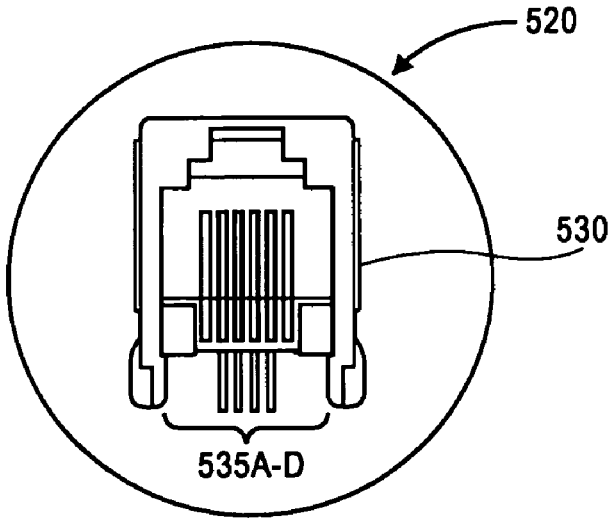
Figure 5C:
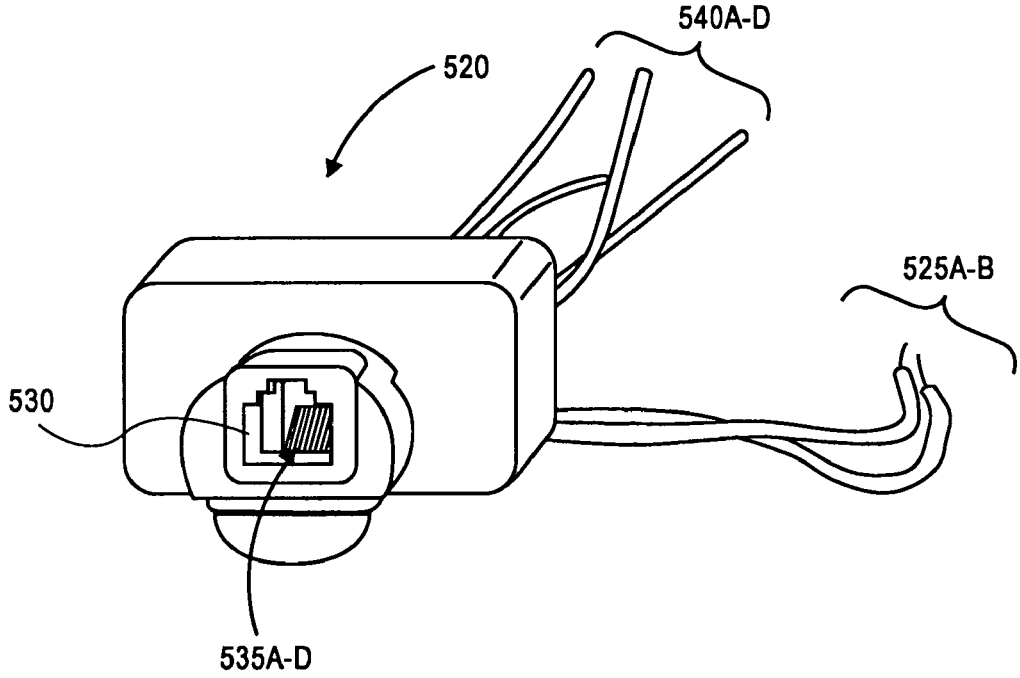

FIGS. 5A-5C illustrate exemplary side views of the control device 520 that may be employed in the system of FIG. 1A. As shown in FIGS. 5A-5C, control device 520 may comprise dimming lines 525A-B, secondary interface 530, and primary interface 537. Dimming lines 525A-B can provide a dimming signal to control dimming ballast(s) which may be housed inside one or more light fixtures 105A-N.

Primary interface 537 may provide physical or electrical isolation and control of the primary power of light fixtures or another load device. Primary interface 537 can include one or more primary high-voltage inputs or outputs, such as primary power supply lines 540C-D and relay wires 540A-B, for example. Relay wires 540A-B may be connected to relay contacts on a relay device to provide pass through or dimming signals to control light fixtures 105A-N or another load device based on input signals transmitted from receiver 145. Of note, dimming lines 525A-B (as described above) and relay wires 540A-B may also be configured to control other ballast types including standard on/off ballasts, step ballasts, or hi/low ballasts. Primary power lines 540C-D may provide power to a power supply (not shown) of control module 520.

Secondary interface 530 may provide low voltage output features to a receiver and may include a plurality of pins, outputs, or inputs 535A-D. In addition, secondary interface 530 can be a low-cost jack of reliable construction, such as a small class 1 or 2 telephone plug, RJ11, RJ14, or RJ45 plug. Secondary interface 530 can comprise a jack having the following pin configurations: pin 535A may provide an input for on/off control of lighting fixtures, pin 535B can be a ground reference for measuring other voltages provided, pin 535C may provide an input for controlling a dimming ballast, such as 0 to 10 Volts (V), and pin 535D may provide a power output, such as 12 Volts (V). Pin 535D may be used to provide power to a receiver 145, for example.

As best shown in FIG. 5A, a stop band 557 may also be provided on the primary interface side (or high power side) of control module 520. Stop band 557 can cover any part of the circumference of primary interface 537 or extend around primary interface 537 to facilitate installation. In exemplary embodiments, stop band 557 can have snap-in detail which can allows primary interface 537 and stop band 557 to snap into a knock out hole of a light fixture and allow relay wires 540C-D and primary power lines 540A-B to be secured. Alternatively, stop band 557 or primary interface 537 may be threaded and/or connected with a standard nut to knock out hole.

As depicted in FIGS. 5B-5C, secondary interface (or low voltage interface) 530 may comprise a standard jack, such as RJ-11. Secondary interface 530 may include a plurality of internal wires which are interfaced into a jack, such as pins 535A-D described above. Additional configurations can be used for the internal wires or pins, such as 0-5 mA output, modulation digital output frequencies, and/or PLC interface communication.

Of note, when control module 520 may not utilize a secondary interface 530 comprising an interface jack, duplicate (or alternate) low voltage lines or wires may be provided. Duplicate low voltage wires may include any of the previously described combinations of features and controls for control device 520. For example, these low voltage lines can include the following: a 0-10V output to ballast(s), a 0-5 mA output to another device (e.g. receiver 145), a low voltage coupler to connect multiple devices, or remote output power. In addition, these lines may be configured to accept low voltage inputs or isolated contact closures from third party motion, daylight, or other lighting based sensors or computing devices.

Figure 6A:
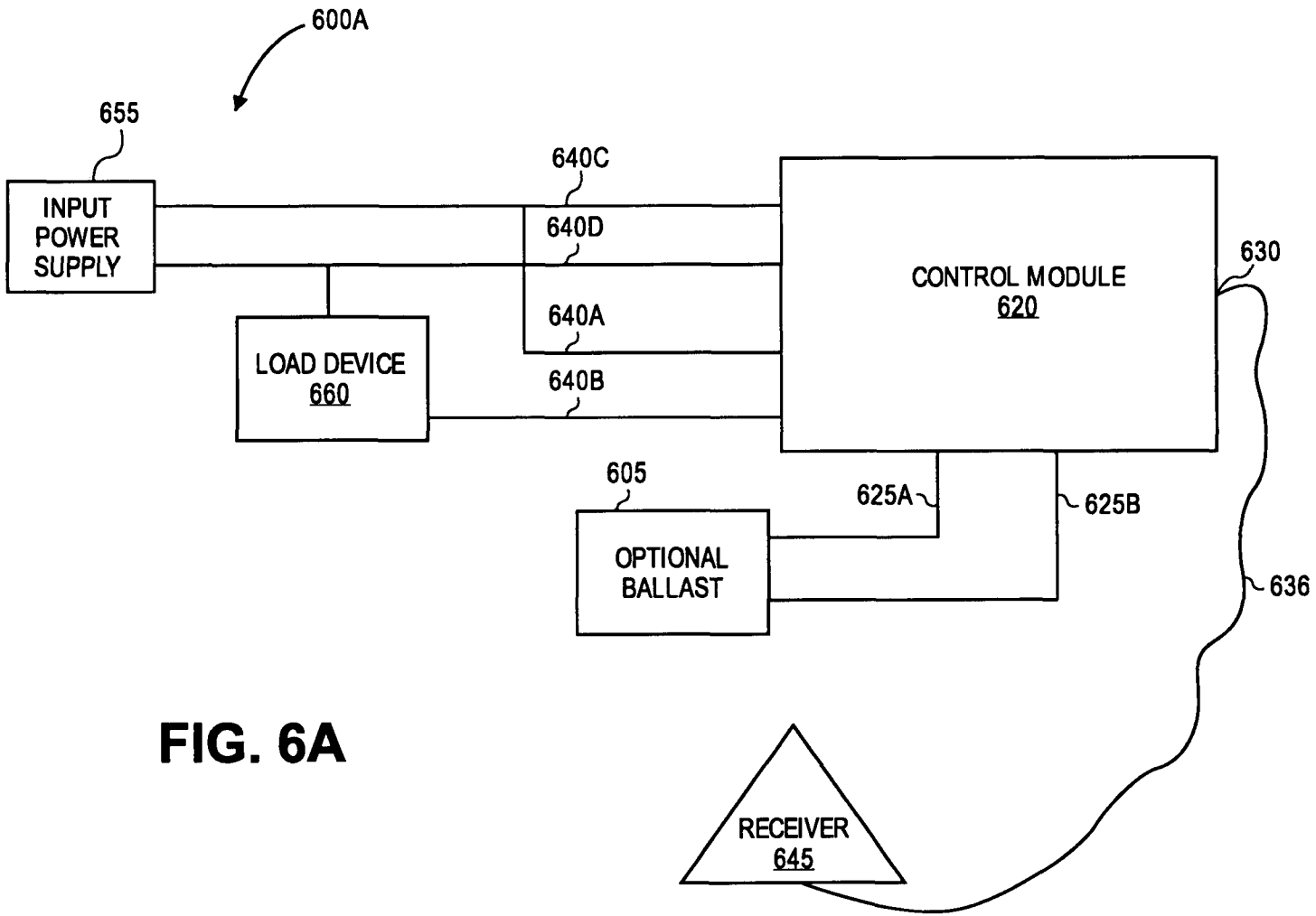
FIGS. 6A-6B illustrate exemplary arrangements of controls for a lighting system, according to embodiments of the disclosure.
Figure 6B:
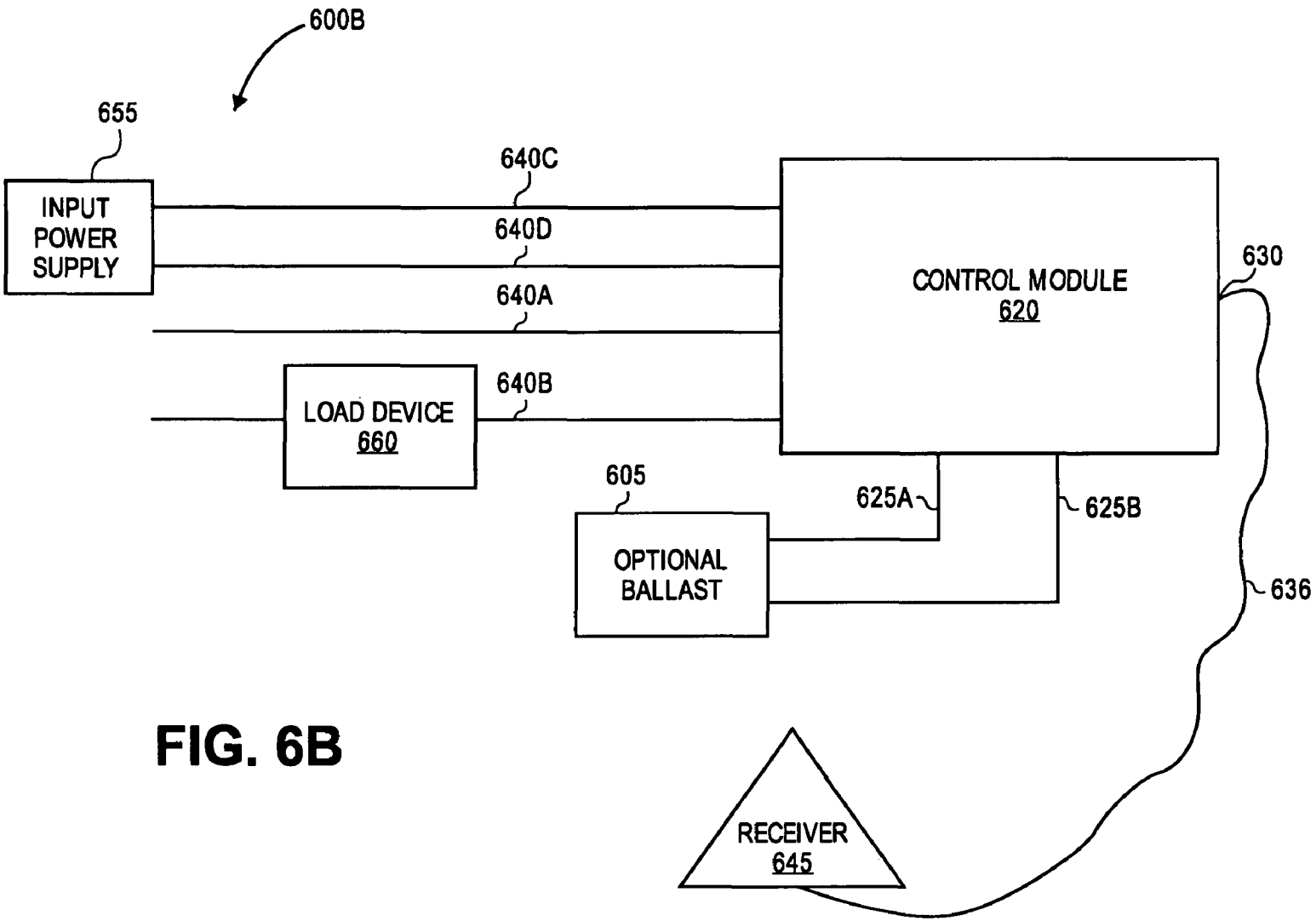

FIGS. 6A-6B illustrate exemplary arrangements of controls for a lighting system. In both FIGS. 6A-6B, systems 600A and 600B can include control device 620 optionally connected to a dimming ballast 605 using dimming lines 625A-B. Additionally, receiver 645 can be connected via secondary interface cable 636 to control device 620. Of note, receiver 645 may be connected to one or more sensors (not shown) via a cable or wireless interface, such as radio. Any type radio signal in the compatible format of the wireless receiver 145 can control the device (via transmission to receiver 145, for example). Although sensors are shown as control elements, the wireless signal can come from a remote wireless control device (e.g. wireless wall switch, handheld remote, network-to-radio-compatible device, etc.). Systems 600A and 600B may also include an input power supply 655, such as an AC universal input power supply.

As shown in FIG. 6A, a combination of relay lines 640A-B and input power supply 655 can be wired to control substantially the same supply and load voltage to load device 660. Load device 660 can be a ballast (regular or dimmable), motor, various light sources, or other relay contactor. As shown in FIG. 6B, a combination of relay lines 640A-B and input power supply 655 can alternatively be wired to control a load device 660 of a substantially different supply than load voltage. Advantageously, input power supply lines 640C-D, which may be black and white wires, can be wired to be an always on back up supply to provide always on power to load device 660, such as for critical time control. Additionally, relay lines 640A-B can control a less critical or higher power load. Alternatively, relay lines 640A-B may control a low-voltage HVAC contactor.

It will be apparent to those skilled in the art that various modifications and variations can be made in the present disclosure without departing from the spirit or scope of the disclosure. Thus, it is intended that the present disclosure cover any modifications and variations within the scope of the appended claims and their equivalents.

What is claimed is:

1. A control module capable of controlling lighting, the control module comprising:

a secondary interface including an input operable to receive at least one input signal configured to control a level of light emitted by a first light source from a receiver and a power output operable to power the receiver; and a primary interface including one or more outputs configured to provide a control signal to adjust light emitted by one or more additional light sources based on the at least one input signal.

2. The control module of claim 1, wherein the one or more outputs of the primary interface comprises at least one dry contact configured to pass through the at least one input signal.

3. The control module of claim 1, wherein the at least one input signal provides on or off control to the first light source and additional light sources.

4. The control module of claim 1, wherein the at least one input signal provides dimming control to the first light source and additional light sources.

5. The control module of claim 1, wherein the primary and secondary interfaces are provided on different sides of the control module.

6. The control module of claim 1, further comprising at least one dimming line output configured to provide dimming control to the first light source based on the at least one input signal.

7. The control module of claim 6, wherein the dimming control comprises a range from approximately zero to ten volts.

8. The control module of claim 1, further comprising a power supply operably connected to the power output of the secondary interface.

9. The control module of claim 8, wherein the primary interface further comprises at least one power supply line connected to the power supply and configured to receive power from an external power source to provide power to the power supply.

10. A lighting system capable of reducing energy consumption, the lighting system comprising:

a junction box; and a control module including a primary interface having at least one power supply line configured to provide a supply voltage to a power supply and at least one relay line configured to relay a signal to control light emitted by at least one light fixture using the junction box.

11. The lighting system of claim 10, wherein the at least one relay line is operably connected to the junction box through a knock out hole.

12. The lighting system of claim 11, wherein the primary interface further comprises a stop band configured to secure the primary interface in the knock out hole.

13. The lighting system of claim 10, wherein the at least one power supply line is operably connected to the junction box to receive the supply voltage.

14. The lighting system of claim 10, wherein the control module further comprises a dimming line configured to provide dimming control to a ballast provided within a housing of the at least one light fixture.

15. The lighting system of claim 14, wherein the dimming line runs through a hole provided in the housing and connects with the ballast.

16. A lighting system comprising:

a secondary interface cable; and a control module including a secondary interface, the secondary interface operable to receive at least one input signal configured to control a level of light emitted by a light fixture from a receiver and a power output operable to power the receiver when connected by the secondary interface cable to the receiver.

17. The lighting system of claim 16, wherein the control module is positioned inside a housing of the light fixture.

18. The lighting system of claim 17, wherein the housing is configured to provide a hole when a knock out piece of the housing is removed.

19. The lighting system of claim 18, wherein the secondary interface is operable to be connected to the receiver through a first hole provided in the housing.

20. The lighting system of claim 18, wherein the control module further comprises one or more power supply lines which exit the housing through a first hole and the secondary interface cable exits the housing through a second hole.

21. The lighting system of claim 18, wherein the control module further comprises one or more relay lines which exit the housing through a first hole and the secondary interface cable exits the housing through a second hole.

22. The lighting system of claim 17, wherein the control module further comprises one or more dimming lines to provide dimming control to a ballast of the light fixture, the dimming lines and the ballast positioned inside the housing and operably connected.

23. The lighting system of claim 16, wherein the control module further comprises a relay configured to relay the at least one input signal to additional light fixtures.

* * * * *